US006148062A

United States Patent [19]

Romeas

[11] Patent Number: 6,148,062

[45] Date of Patent: Nov. 14, 2000

[54] X-RAY BEAM-SHAPING FILTER AND X-RAY IMAGING MACHINE INCORPORATING SUCH A FILTER

[75] Inventor: René Romeas, Palaiseau, France

[73] Assignee: GE Medical Systems, S.A., France

[21] Appl. No.: 09/184,569

[22] Filed: Nov. 2, 1998

[30] Foreign Application Priority Data

Nov. 3, 1997 [FR] France ..... 97 13781

[51] Int. Cl.[7] ..... G21K 3/00

[52] U.S. Cl. ..... 378/156; 378/157; 378/159

[58] Field of Search ..... 378/156, 157, 378/158, 159, 150

[56] References Cited

U.S. PATENT DOCUMENTS

| | | | |
|---|---|---|---|
| 3,115,580 | 12/1963 | Brewer | 250/105 |
| 4,219,734 | 8/1980 | Chery | 378/24 |
| 4,233,519 | 11/1980 | Coad | 250/514 |
| 4,947,417 | 8/1990 | Coad | 250/514 |
| 5,086,444 | 2/1992 | Bartmann | 378/152 |
| 5,200,986 | 4/1993 | Schlie | 378/156 |
| 5,991,362 | 11/1999 | Jones | 378/152 |

FOREIGN PATENT DOCUMENTS

| | | |
|---|---|---|
| 0373285 | 6/1990 | European Pat. Off. . |
| 2676584 | 11/1992 | France . |

*Primary Examiner*—David P. Porta
*Assistant Examiner*—Diane I. Lee
*Attorney, Agent, or Firm*—Jay L. Chaskin

[57] ABSTRACT

A filter having compensating plates, each having a first plate element which can be moved translationally with respect to a frame and a second plate element which can be moved relative to the first plate element so that, when the plates are in an active position, the thickness of absorbent material through which the X-ray beam passes is constant.

16 Claims, 7 Drawing Sheets

X-RAY BEAM-SHAPING FILTER AND X-RAY IMAGING MACHINE INCORPORATING SUCH A FILTER

BACKGROUND OF THE INVENTION

The present invention relates in a general way to an X-ray filter for shaping the beam of rays and compensating for the differences in X-ray absorption by a region under examination of a body having areas of different absorption densities and thus avoiding overexposure of the image obtained in the areas of the image corresponding to the areas of low absorption densities. The invention also relates to X-ray imaging machines incorporating such a filter, in particular medical imaging machines.

Digital X-ray imaging machines used for vascular or cardiac imaging are generally provided with field-shaping (FS) filters inserted into the path of the X-ray beam, between the X-ray source and the region under examination of a patient's body, in order to avoid overexposure of the contour of the image obtained due to saturation of the video camera of the machine. This is because, in some cases, the region under examination of a patient's body may have very dense areas contiguous with low-density areas. This is the case, for example, in pulmonary vascular examinations in which the areas of the spinal column and heart are very dense compared to the area of the lungs. The insertion of a filter made of an X-ray-absorbent material opposite the low-density areas makes it possible to equalize the image contrast in the areas of the image corresponding to the low-density areas of the region examined.

Referring to FIG. 1, which shows diagrammatically the principle of operation of a shaping filter, an X-ray beam passes through a region 1 of a patient's body, which includes an area 2 of low absorption density, and is then collected by an image intensifier whose output signals are processed in the imaging machine (not shown) in order to obtain an image of the region 1 examined. A shaping filter 5, placed in the X-ray beam 3 between the X-ray source and the region 1 examined, has a central opening 6 defining the field of view of the image obtained. In order to avoid overexposure of the image in that area of the latter corresponding to the low-density area 2 of the region 1 under examination, a movable thin plate of the filter 5, made of X-ray-absorbent material, is moved by the operator in such a way that this plate covers an area of the central opening 6 of the filter corresponding to the low-density area 2 of the region 1 examined. Thus, overexposure of the image in this area is avoided because of the absorption of the X-rays by the thin plate which compensates for the low absorption by the low-density area 2.

Depicted in FIG. 2 is a shaping filter 10 conventionally used in X-ray imaging machines. The shaping filter 10 comprises a main frame 11 in the form of a flat ring having a central circular opening 12 for the passage of the X-ray beam. Two parallel straight sliding rails 13, 14 are fixed to one of the main surfaces of the main frame 11 in diametrically opposed positions.

Two curved compensating plates 17, 18, made of X-ray-absorbent material, having the general shape of crescents whose curvature corresponds to that of the central opening 12, are joined by one of their ends by means of a carriage (not depicted), each respectively, to one of the sliding rails 13, 14 so as to be able to be moved over the main frame 11, one plate over the other, by translation along their respective rail, between a retracted position in which the compensating plates 17, 18 lie almost entirely over the main frame 11 and active positions in which the plates 17, 18 are over the central opening 12.

As shown in FIG. 2, the compensating plates 17, 18 are placed symmetrically with respect to the center 15 of the main frame 11.

When the plates of the compensation 17, 18 are in their retracted positions, the internal edges of the plates 17, 18 define the maximum field of view 19 of the X-ray image and when they are in active positions they define the effective field of the X-ray image. Thus, by adjusting the position of the plates 17, 18 by translation along the rails 13, 14, the contour of the field of view is defined and the differences in absorption can be compensated for.

The entire filter 10 can rotate about the center 15 in order to comply with the orientation of the region examined.

It would be desirable to be able to use standard shaping filters, like the one in FIG. 2, in order to define the field of view and obtain the desired absorption compensation, but the mechanism for moving the plates 17, 18 of these filters limits the maximum width (x) of the plates to the width (y) between the maximum field of view 19 and the outer edge of the main frame 11. Unfortunately, the wide low-density areas of a patient (for example, the lungs) exceed the capabilities of the conventional shaping filters, such as those in FIG. 2. It would be possible to design an entirely new mechanism, but this solution would be expensive and would increase the volume of the X-ray-beam collimator in unacceptable proportions.

BRIEF SUMMARY OF THE INVENTION

An embodiment of the present invention is a shaping filter which allows for compensation for wide low-density areas of the patient.

An embodiment of the invention is a compensating filter which does not unduly enlarge the X-ray-beam collimator.

An embodiment of the present invention is an X-ray imaging machine incorporating such a filter.

In one embodiment an X-ray beam-shaping filter of variable area comprises:

a main frame in the form of a flat ring having a central circular opening for passage of an X-ray beam, at least one sliding rail fixed to one of the main surfaces of the main frame, and at least one compensating plate, made of X-ray-absorbent material, which can be moved along the rail between a retracted position in which the compensating plate lies outside a maximum field of view of the X-ray beam and active positions in which the compensating plate lies at least partly within the maximum field of view of the X-ray beam wherein the compensating plate comprises a first and a second plate element which can be moved one relative to the other in such a way that, when the plate is in an active position, the plate thickness through which the X-ray beam passes is constant.

In one embodiment of the invention, the filter comprises two parallel straight rails, placed diametrically opposite each other on the main frame, and two compensating plates each joined respectively to a rail.

In one embodiment of the filter the plate elements can be moved rotationally one with respect to the other.

In another embodiment of the invention, the plate elements can be moved transitionally one with respect to the other.

DETAILED DESCRIPTION OF THE INVENTION

In the figures, the same elements are identified by the same reference numbers.

Figure 3:
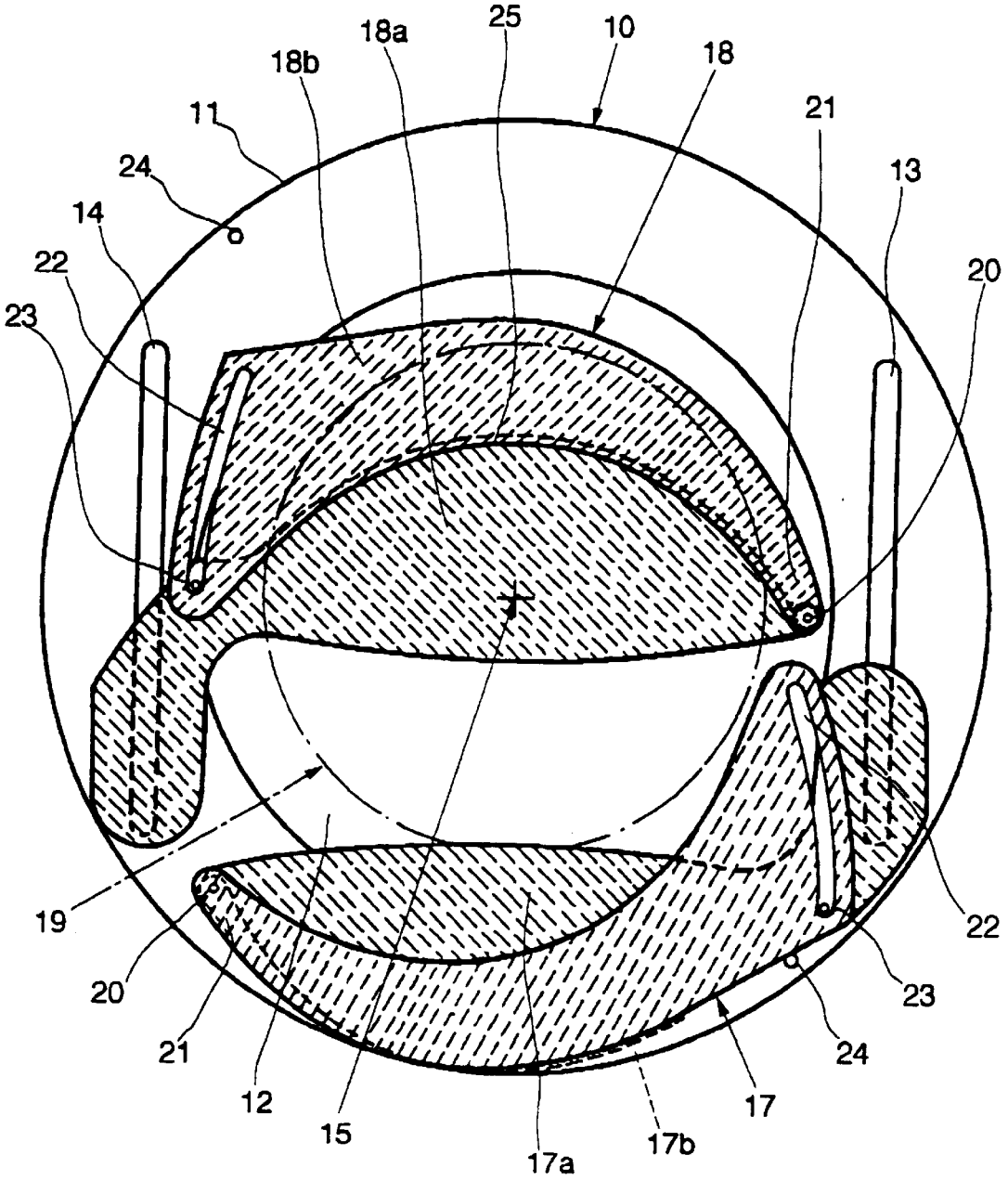
FIG. 3 is a top view of one embodiment of a shaping filter according to the invention with one plate in its retracted position and one plate in its fluid active position.

Reference is more particularly made to FIG. 3, in which a first embodiment of an X-ray beam-shaping filter 10 of variable area has been depicted.

Figure 1:
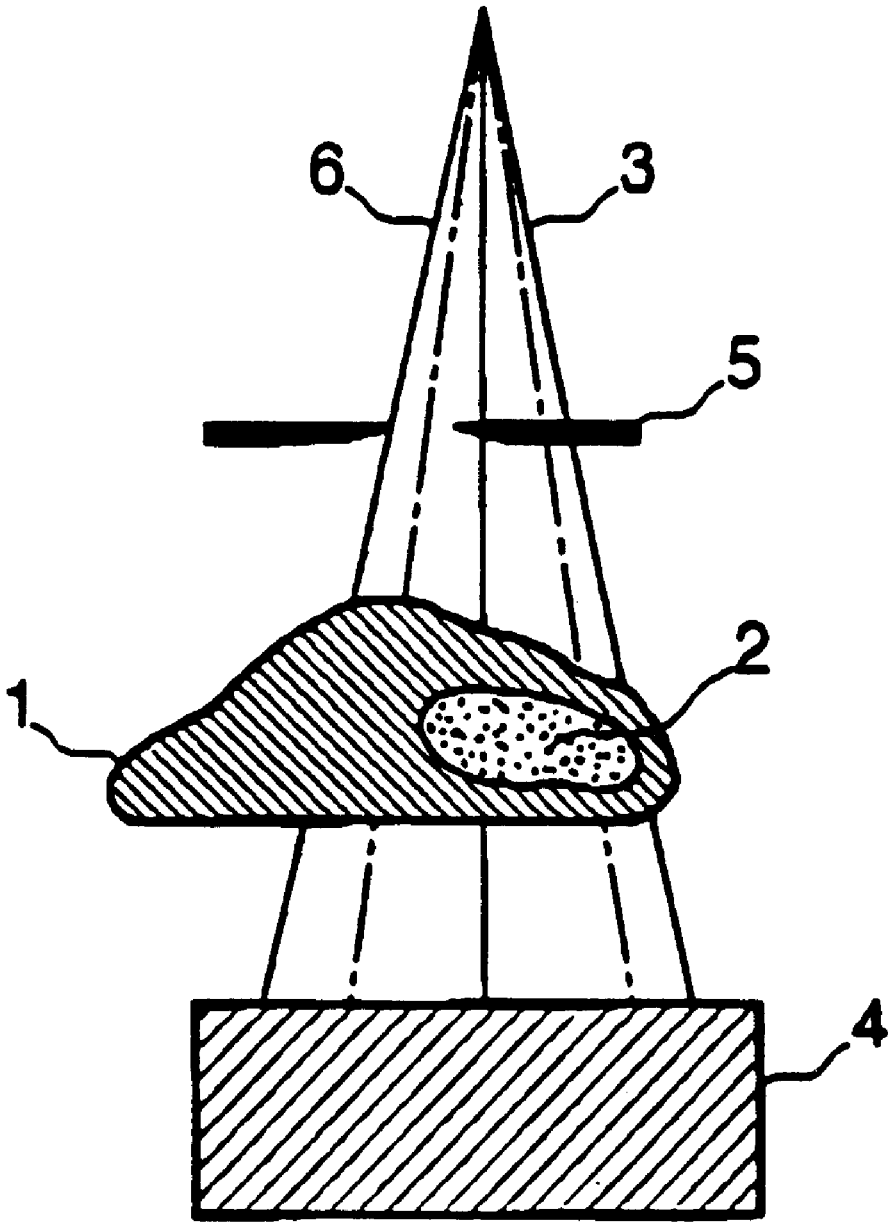
FIG. 1 (PRIOR ART)
FIG. 1 is a diagrammatic view showing the operation of a conventional shaping filter.
Figure 2:
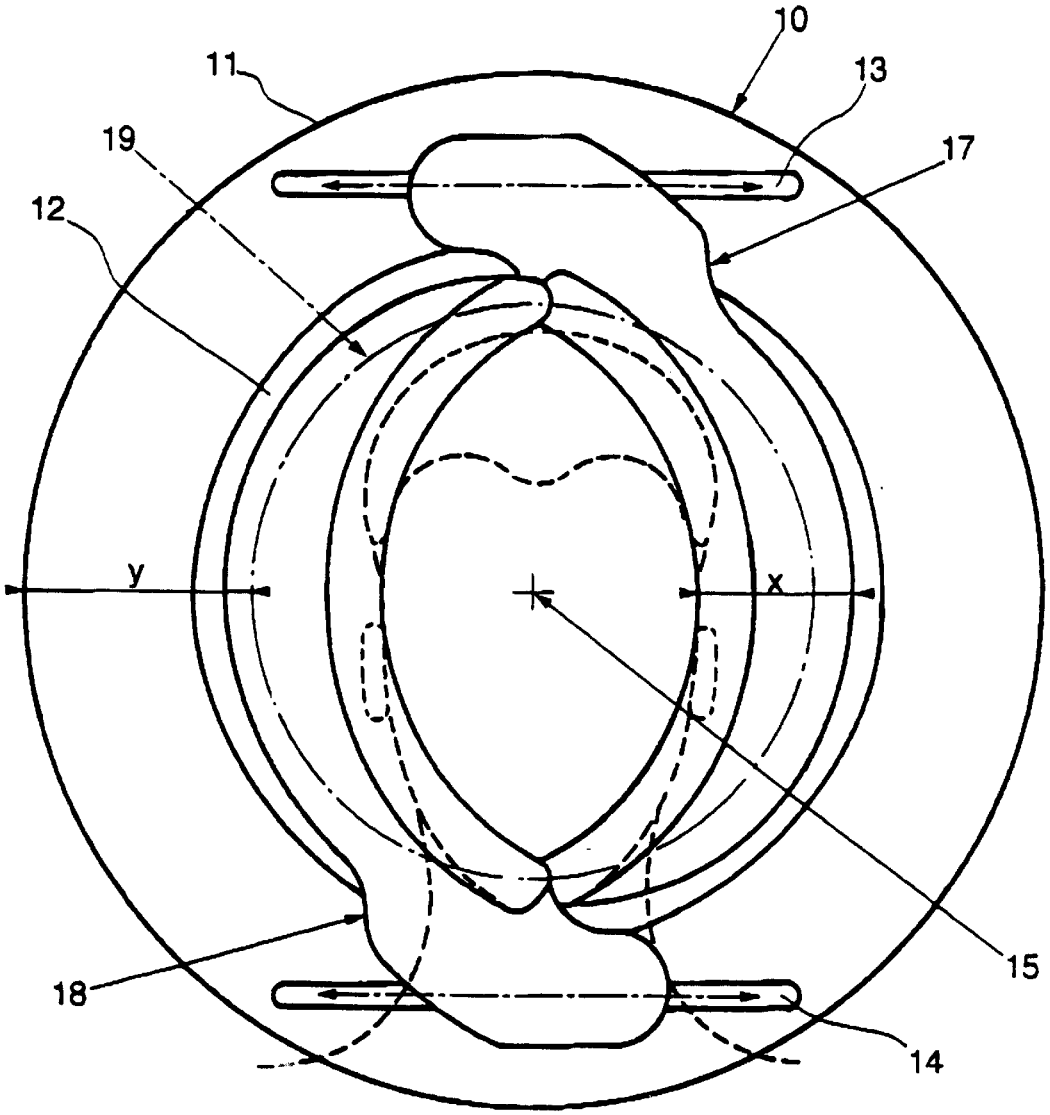
FIG.2 (PRIOR ART)
FIG. 2, is a top view of a shaping filter of the prior art.

This filter, like the filter of the prior art in FIG. 2, comprises a main frame 11 provided with sliding rails 13, 14 and two compensating plates 17, 18 made of X-ray-absorbent material.

Since the general structure is similar to that of the conventional filter in FIG. 2, in particular with regard to the arrangement of the plates 17, 18 on the rails 13, 14 by means of carriages (not depicted), reference should be made to the previous description of this figure for greater details.

The shaping filter 10 of one embodiment of the invention differs from that of the prior art by the arrangement of the compensating plates 17, 18.

Given that the compensating plates 17, 18 are identical, the following description relating to one of the plates applies in extends to the other compensating plate.

The compensating plate 17 comprises a first plate element 17*a* having the general shape of a biconvex meniscus comprising a first end joined conventionally to a carriage which can move translationally on the rail 13 and a second end, opposite the first, provided with a pivot pin 20.

A second plate element 17*b*, having the general shape of a scythe blade, has a first end mounted so as to pivot on the pivot pin 20 and an enlarged second end, opposite the first, having a curved elongate slot 22. A stud 23 projects from the first plate element 17*a* in order to fit into the elongate curved slot 22 at the enlarged second end of the second plate element 17*b*. A stress spring 21, placed around the pivot pin 20, is joined by one of its ends, respectively, to the first and second plate elements 17*a*, 17*b*.

Finally, a stop 24 is provided on the main frame 11 in order to keep the second plate element 17*b* in its initial position, as will be seen later.

Figure 6:
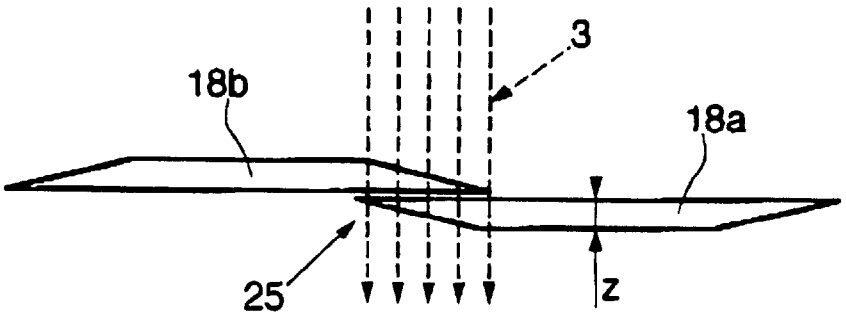
FIG. 6 is a diagrammatic view of the minimum overlap area of the compensating plate elements of the filter of FIG. 3.

In FIG. 3, the plate 17 has been depicted in its retracted position in which the first and second plate elements 17*a*, 17*b* are in their initial position in which these plate elements overlap almost entirely. In contrast, the plate 18 has been depicted in its final active position and the plate elements have been depicted in their maximum deployed position in which the first and second plate elements 17*a* and 18*b* now overlap only over a minimum area 25 along the outer edge of the first plate element 18*a* and along the inner edge of the second plate element 18*b*. Those parts of the plate elements 18*a* and 18*b* which correspond to this overlap area 25 are bevelled so that the overlap area 25 has a thickness identical to the rest of the plate 18, as may be seen in FIG. 6. The plate elements 18*a*, 18*b* have an identical thickness in their non-bevelled parts.

Although the second plate elements 17*b*, 18*b* have been depicted as pivoting above the first plate elements 17*a*, 18*a*, it is also possible to place them in the same manner below the first plate elements 17*a*, 18*a*.

The operation of the filter 10 is described with reference to FIGS. 3 to 6.

Initially, the plates are in the retracted position, depicted in FIG. 3 in respect of the plate 17, in which the first plate element 17*a* is pushed back by sliding at one end of the rail 13 as far as a position in which, by rotation under the effect of the bearing force of the stop 24 against the spring 21, the stud 23 bears on one end of the slot 22 and the plate elements are in their initial position and overlap almost entirely.

Figure 5:
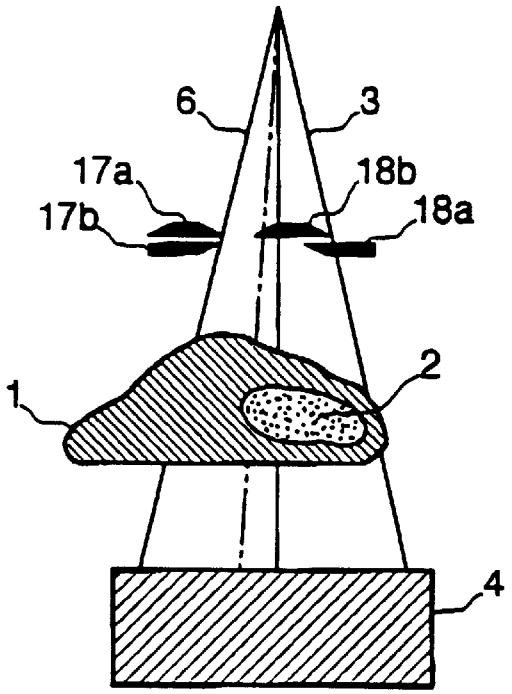
FIG. 5 is a diagrammatic view showing the operation of the shaping filter of FIG. 3.

When the user wishes to shape the field of view of a region 1 of a patient under examination which includes a wide area 2 of low absorption density, so as to compensate for the lowest absorption of the X-ray beam 3 by the low-density area 2 as depicted in FIG. 5, he moves the first plate element, for example 18*a*, by sliding it along the rail 14 in order to end up over the low-density area. Under the action of the spring 21, the second plate element 18*b* pivots about the pin 20 and is deployed, the sliding of the stud 23 in the slot 22 during pivoting of the second plate element causing this element to pivot uniformly. At this stage, the plate is in an active position.

Figure 4:
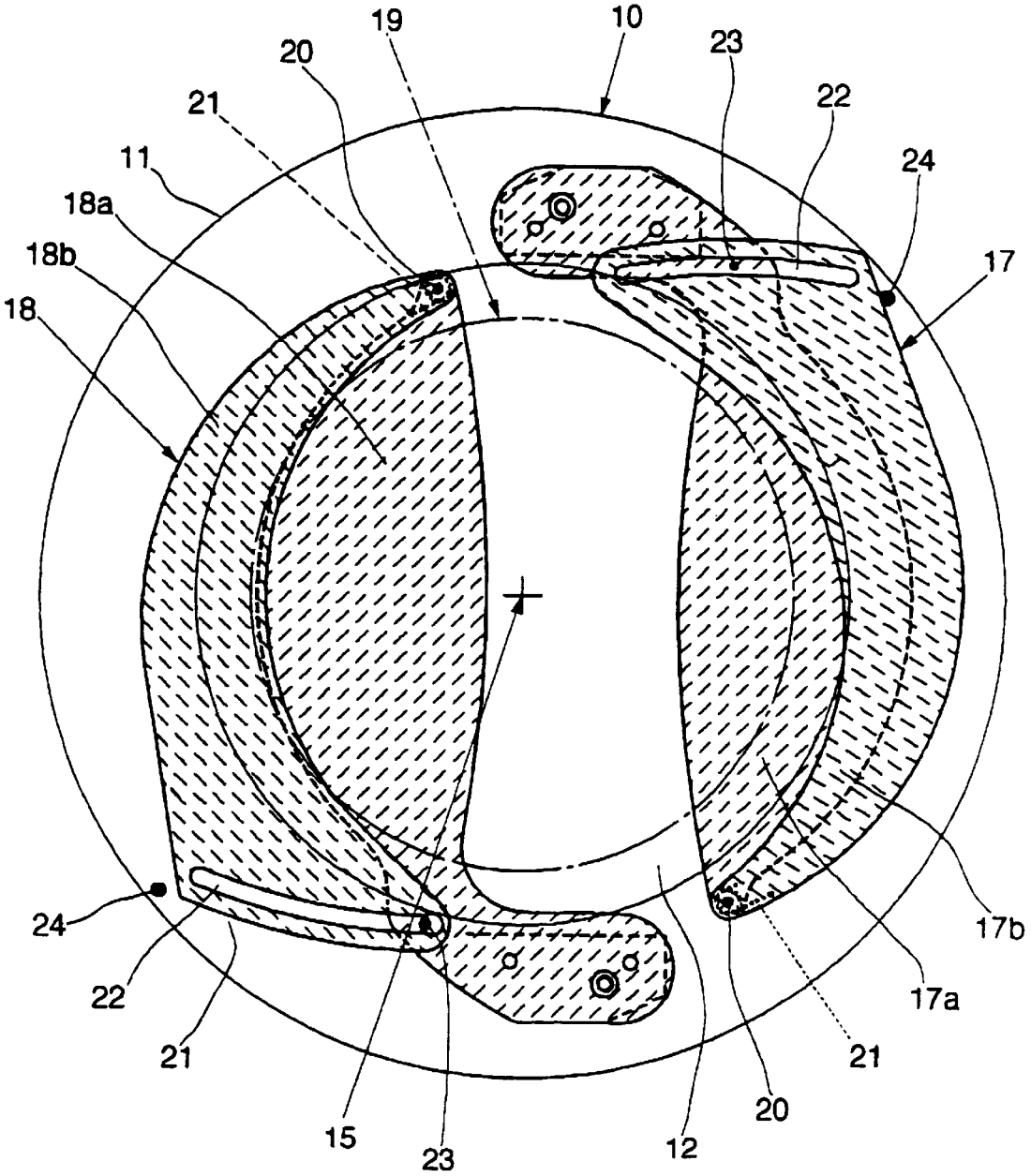
FIG. 4 is a top view of the filter of FIG. 3 with the plates in intermediate active positions.

Referring more particularly to FIG. 4, the plate 17 is brought by the user into an intermediate active first position in which the overlap area 25 of the plate elements 17*a* and 17*b* is large, but as may be seen in FIG. 4 this relatively large overlap area 25, because of the shape and size of the plate elements, lies entirely over the frame 11 and, consequently, only part of the plate element 17*a* lies in the field of view 19 of the X-ray beam and is active in order to absorb part of this X-ray beam. Since the thickness of this plate element 17*a* is constant, the compensation produced is uniform.

The other plate 18, in the case of FIG. 4, is in an intermediate active position close to the final active position and, as may be seen in FIG. 4, the plate element 18*b* was deployed under the effect of the spring 21 and the overlap area of the plate elements 18*a*, 18*b* is almost the minimum, but it lies slightly within the field of view 19.

However, because of the fact that this small overlap area 25 corresponds to appropriate bevelled parts of the plate elements 18*a*, 18*b*, the thickness in this overlap area 25 is almost equal to the thickness of the rest of the plate element 18*a* lying in the field of view 19. Uniform compensation over the entire desired part of the field of view 19 is therefore obtained.

Referring again to FIG. 3, the plate 18 has been depicted in its final active position in which the spring 21 has pivoted the plate element 18*b* until the end of the slot 22 butts against the stud 23. In this position, the area of the field of view 19 covered by the plate is the maximum area. The overlap area 25 of the plate elements 18*a*, 18*b* is the minimum and, as previously, because of the bevelling of the corresponding parts of the plate elements, has a thickness equal to the remaining parts of the plate elements. Thus, uniform compensation over the entire area of the field of view covered by the plate 18 is obtained.

Figure 7:
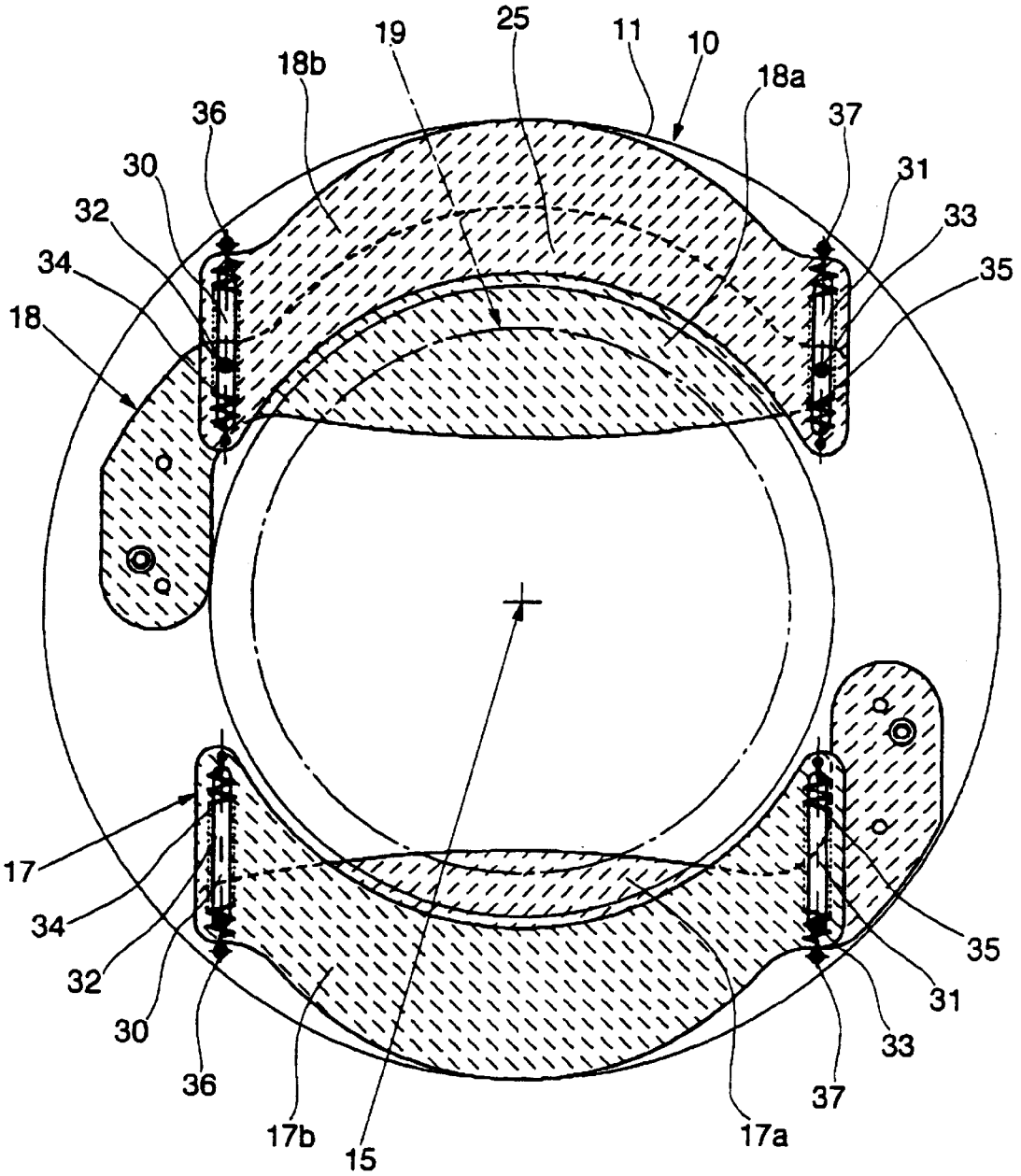
FIG. 7 is a top view of another embodiment of the filter according to the invention with one plate in the initial retracted position and the other plate in an intermediate active position.
Figure 8:
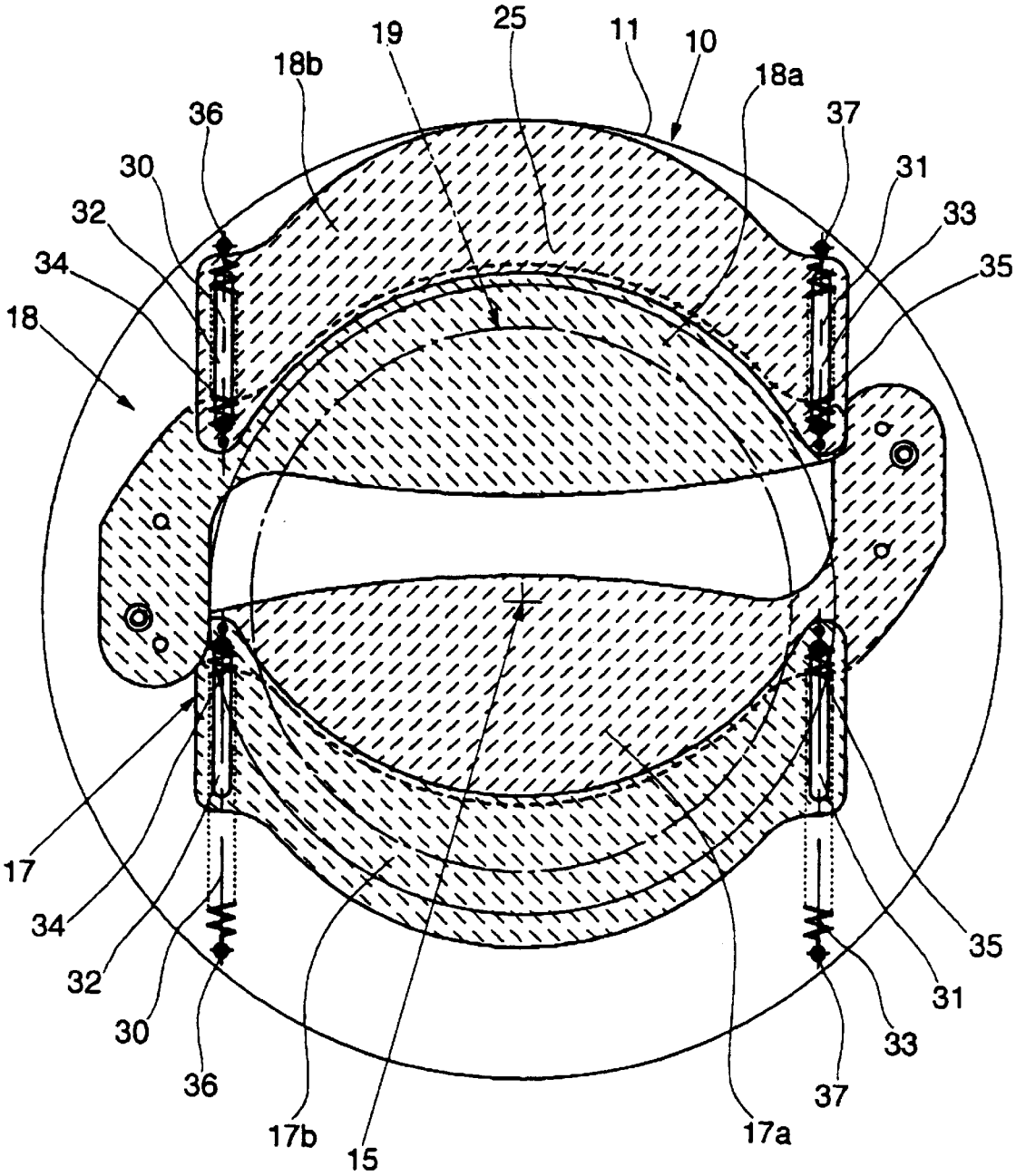
FIG. 8 is a top view of the filter of FIG. 7, with one plate in another intermediate active position and the other plate in its final active position.

Depicted in FIGS. 7 and 8 is a filter according to another embodiment of the invention which differs from the filter described above by the fact that the plate elements 17*a*, 17*b* and 18*a*, 18*b* can be moved in relative translation, one with respect to the other, and by the means allowing this relative translation of the plate elements.

The second plate element 18*a*, 18*b* is a curved plate of almost constant width provided at both its ends with parallel straight slots 31, 32. Since the slots 30, 31 allow the second plate element 18*a*, 18*b* to move translationally along two studs 32, 33 fixed to the first plate element 17*a*, 17*b*. Return springs 34, 35 are fixed both to the support plate and to the second plate element 17*b*, 18*a*.

FIG. 7 depicts the plate 17 in its initial retracted position in which the overlap of the plate elements is the maximum. In this position, the plate rests on the stops 36.

When the user moves the first plate element 18*a*, by sliding it along the rail, in order to bring it into a first intermediate active position, as depicted in FIG. 7, the second plate element 18*b* remains stationary.

The overlap area 25 remains large but it lies entirely over the main frame 11 and only part of the first plate element lies in the field of view 19. Because of the constant thickness of the plate element, the X-ray beam is therefore uniformly attenuated.

When the user brings the first plate element into the position depicted in respect of the plate 18 in FIG. 8, the second plate element 18*b* has still not been moved, but the studs 32, 33 butt against the front end of the slots 30, 31. The overlap area 25 of the plate elements is the minimum area and, because of the fact that the plate elements have suitable bevelled parts in this minimum overlap area 25, the thickness remains constant.

When the user slides the first plate element into the final active position of the plate 17 in FIG. 8, the second plate element 17*b* is driven by the first plate element 17*a* under the action of the studs 32, 33 on the front ends of the slots 30, 31 and against the return force of the springs 34, 35.

Of course, conventional locking means are provided in order to keep the plates in the positions chosen by the user.

In the position of the plate 17 depicted in FIG. 8, the area of the field of view covered by the plate is the maximum. Although the minimum overlap area 25 lies within the field of view, the thickness of material through which the X-ray beam passes remains constant, for the reasons given above, and uniform attenuation is obtained.

Although the embodiments of the invention have been described with filters having two rails and two plates, it is possible to produce filters having a single rail and a single plate, or more than two rails and two plates, for example four rails and four plates diametrically opposed in pairs.

Various modifications in structure and/or function and/or steps may be made by one skilled in the art to the disclosed embodiments without departing from the scope and extent of the invention.

What is claimed is:

1. A beam-shaping filter of variable area, which comprises a main frame in the form of a flat ring provided with a central circular opening for passage of a beam of radiation, at least one sliding rail fixed to one of the main surfaces of the main frame and at least one compensating plate made of a radiation-absorbent material, which can be moved along the rail between a retracted position in which the compensating plate lies outside a maximum field of view of the beam and active positions in which the compensating plate lies at least partly within the maximum field of view of the beam wherein the compensating plate comprises a first and second plate element which can be moved one relative to the other in such a way that, when the plate is in an active position, the thickness of absorbent material through which the beam passes is constant.

2. Filter according to claim 1 wherein the plate elements can be moved rotationally.

3. Filter according to claim 2 wherein the first plate element is joined by a first of its ends to the sliding rail and the second plate element is joined, so as to pivot by a first of its ends, to a second of the ends of the first plate element opposite the first end.

4. Filter according to claim 3 wherein the second plate element rotates with respect to the first plate element by the second plate element pivoting with respect to a pivot pin connected to the second end of the first plate element and to a first end of the second plate element.

5. Filter according to claim 4 wherein a second end of the second plate element has a curved elongate slot into which a stud engages, this stud being fixed to the first plate element and sliding in the slot in order to guide the second plate element during its rotation.

6. Filter according to claim 5 wherein the plate comprises a stressed spring joined respectively by one of its ends to the first and second plate elements so that the second plate element rotates with respect to the first plate element automatically under the action of the spring during the movement of the plate from its retracted position to an active position.

7. Filter according to claim 6 wherein a stop is fixed to the main frame so that, when the plate is in its retracted position, the second plate element is held in place against the force exerted by the spring.

8. Filter according to claim 4 wherein the plate comprises a stressed spring joined respectively by one of its ends to the first and second plate elements so that the second plate element rotates with respect to the first plate element automatically under the action of the spring during the movement of the plate from its retracted position to an active position.

9. Filter according to claim 8 wherein a stop is fixed to the main frame so that, when the plate is in its retracted position, the second plate element is held in place against the force exerted by the spring.

10. Filter according to claim 9 wherein the second plate element is a curved plate of constant width.

11. Filter according to claim 10 wherein the relative translation between the first plate element and the second plate element is provided by a pairs of studs fixed to the first plate element engaging in parallel straight slots provided in the second plate element.

12. Filter according to claim 1 wherein the plate elements can be moved in relative translation.

13. Filter according to claim 12 wherein the relative translation between the first plate element and the second plate element is provided by a pairs of studs fixed to the first plate element engaging in parallel straight slots provided in the second plate element.

14. Filter according to claim 1 wherein the plate elements have a minimum overlap area in the maximum field of view of the beam and in that they are bevelled in their parts corresponding to the minimum overlap area in such a way that the thickness of absorbent material through which the beam passes is constant.

15. Filter according to claim 1 comprising two diametrically opposed parallel straight rails and two compensating plates each of which can be moved respectively on one of the rails.

16. An imaging machine comprising a source of beam radiation, a shaping filter disposed in the beam and means for collecting the radiation and forming an image wherein the shaping filter comprises a main frame in the form of a flat ring provided with a central circular opening for passage of a beam of radiation, at least one sliding rail fixed to one of the main surfaces of the main frame and at least one compensating plate made of a radiation-absorbent material, which can be moved along the rail between a retracted position in which the compensating plate lies outside a maximum field of view of the beam and active positions in which the compensating plate lies at least partly within the maximum field of view of the beam wherein the compensating plate comprises a first and second plate element which can be moved one relative to the other in such a way that, when the plate is in an active position, the thickness of absorbent material through which the beam passes is constant.

* * * * *